United States Patent [19]

Cawlfield

[11] Patent Number: 4,784,875

[45] Date of Patent: Nov. 15, 1988

[54] PROCESS FOR TREATMENT OF SEPARATOR FOR SODIUM HYDROSULFITE MEMBRANE CELL

[75] Inventor: David W. Cawlfield, Cleveland, Tenn.

[73] Assignee: Olin Corporation, Cheshire, Conn.

[21] Appl. No.: 145,442

[22] Filed: Jan. 19, 1988

Related U.S. Application Data

[63] Continuation-in-part of Ser. No. 080,267, Jul. 31, 1987, abandoned, which is a continuation-in-part of Ser. No. 032,803, Apr. 1, 1987, Pat. No. 4,740,287, which is a continuation-in-part of Ser. No. 944,273, Dec. 19, 1986, Pat. No. 4,743,350, which is a continuation-in-part of Ser. No. 892,518, Aug. 4, 1986.

[51] Int. Cl.[4] ..... B05D 5/12; B05D 3/04

[52] U.S. Cl. ..... 427/126.3; 427/126.1; 427/243; 427/343; 427/380

[58] Field of Search ..... 427/126.3, 243, 343, 427/126.1, 380

[56] References Cited

U.S. PATENT DOCUMENTS

| | | | |
|---|---|---|---|
| 2,728,691 | 12/1955 | Beacham et al. | 427/343 |
| 3,228,795 | 1/1966 | Ackermann | 427/343 |
| 4,444,642 | 4/1984 | Hinden et al. | 204/290 F |
| 4,496,451 | 1/1985 | Ishii et al. | 204/252 |
| 4,725,451 | 2/1988 | Cripe | 427/343 |

*Primary Examiner*—Janyce Bell
*Attorney, Agent, or Firm*—Ralph D'Alessandro

[57] ABSTRACT

A process for treating the surfaces of a polymeric separator mesh for use in an electrochemical cell between an anode and a membrane to obtain a hydrophilic coating.

17 Claims, 1 Drawing Sheet

PROCESS FOR TREATMENT OF SEPARATOR FOR SODIUM HYDROSULFITE MEMBRANE CELL

This application is a continuation-in-part application of U.S. Ser. No. 080,267 filed July 31, 1987, now abandoned, which in turn is a continuation-in-part application of U.S. Ser. No. 032,803 filed Apr. 1, 1987, now U.S. Pat. No. 4,740,287 which in turn is a continuation-in-part, application of U.S. Ser. No. 944,273 filed Dec. 19, 1986, now U.S. Pat. No. 4,743,350 which in turn is a continuation-in-part application of U.S. Ser. No. 892,518 filed Aug. 4, 1986; all assigned to the assignee of the present invention.

BACKGROUND OF THE INVENTION

This invention relates to a separator for use between an electrode and a membrane in an electrochemical membrane cell. More particularly the present invention relates to the coating and the process used to treat the polymer surfaces of the separator to make it hydrophilic.

Many unsuccessful attempts have been made at developing a process for manufacturing alkali metal hydrosulfites, such as sodium hydrosulfite or potassium hydrosulfite, electrochemically that can compete commercially with conventional zinc reduction processes using either sodium amalgam or metallic iron. The electrochemical process for making hydrosulfite involves the reduction of bisulfite ions to hydrosulfite ions. For this process to be economical, current densities must be employed in a cell which are capable of producing concentrated hydrosulfite solutions at high current efficiencies.

Control of undesirable electrochemical byproduct thiosulfate formation in hydrosulfite produced for use in the paper and pulp industry as a strong reducing agent or bleaching agent is essential. At the high concentrations of hydrosulfite previously produced by the electrochemical route, however, this byproduct reaction is more difficult to control.

Additionally, prior eleotzochemical routes to hydrosulfite have produced aqueous solutions which are unstable and decompose at a rapid rate. This high decomposition rate of hydrosulfite appears to increase as the pH decreases or the reaction temperature increases. One approach to control the decomposition rate is to decrease the residence time of the solution in the cell and to maintain the current density as high as possible up to a critical current density above which secondary reactions will occur due to polarization of the cathode.

Some of the processes of the prior art, which claim to make hydrosulfite salts electrochemically, require the use of water-miscible organic solvents, such as methanol, to reduce the solubility of the hydrosulfite and prevent its decomposition inside the cell. The costly recovery of the methanol and hydrosulfite makes this route uneconomical.

The use of zinc as a stabilizing agent for hydrosulfites in electrochemical processes has also been reported, but because of environmental considerations, this is no longer commercially practical or desirable.

More recently, U.S. Pat. No. 4,144,146 issued Mar. 13, 1979 to B. Leutner et al describes an electrochemical process for producing hydrosulfite solutions in an electrolytic membrane cell. The process employs high circulation rates for the catholyte which is passed through an inlet in the bottom of the cell and removed at the top of the cell to provide for the advantageous removal of gases produced during the reaction. Catholyte flow over the surface of the cathodes is maintained at a rate of at least 1 cm per second and the cathode is formed of fibrous mats of compressed sintered fibers with a mesh spacing of 5 mm or less. The process is described as producing concentrated solutions of alkali metal hydrosulfites at commercially viable current densities; however, the cell voltages required are high, being in the range of 5 to 10 volts. This results in excessive energy consumption. There is no indication of the concentrations of thiosulfate impurity in the product solutions.

The availability of electrodes with a high mass transfer surface area having a high surface area to volume ratio and sufficient porosity have limited the development of a commercially practical electrochemical cell design for the production of aqueous solutions of alkali metal sulfites with low concentrations of alkali metal thiosulfates as impurities. The electrodes must also seal well, be uniformly spaced apart, easily assembled and not contribute to the production of thiosulfate impurities.

These and other problems are solved in the design of the present electrolytic cell which employs an improved hydrophilic separator between the anode and the membrane in the cell to produce an alkali metal hydrosulfite. The present invention makes the surfaces hydrophilic without the traditional addition of a surfactant to the electrolyte or coating the separator's polymeric surfaces with a surface active agent that is susceptible to being easily washed off of the surfaces.

SUMMARY OF THE INVENTION

It is an object of the present invention to provide an improved separator for use in an electrochemical cell.

It is another object of the present invention to provide a separator which provides improved wettability in alkali metal hydrosulfite solutions.

It is a feature of the present invention that the improved separator is coated with titanium dioxide on its surfaces.

It is another feature of the present invention that the titanium dioxide coated separator is made from polypropylene.

It is an advantage of the present invention that the coated separator surfaces are hydrophilic.

It is another advantage of the present invention that the coated separator surfaces have improved wettability and high absorbency without reducing the surface tension of the electrolyte.

It is yet another advantage of the present invention that the coating on the separator surfaces is well adhering and uniform so that it does not wash off.

It is still another feature that the contact angle, used as a measure of wettability or spreadability, of the electrolyte with the separator surface is reduced from about 100 degrees to less than about 5 degrees by the present invention.

These and other objects, features and advantages of the invention are provided in an electrolytic membrane cell that electrochemically produces an alkali metal hydrosulfite by the reduction of an alkali metal bisulfite component of a circulated aqueous catholyte solution in a cell having an improved separator positioned between the adjacent anode backplates and membranes by the process of coating the polypropylene separator surfaces with a well-adhering film of titanium dioxide that is applied by spraying a titanium solution on the previously washed polypropylene mesh, drying the solution, then treating the coated mesh with an oxidizing agent to convert the titanium salts to titanium dioxide.

BRIEF DESCRIPTION OF THE DRAWINGS

The objects, features and advantages of the invention will become apparent upon consideration of the following detailed disclosure of the invention, especially when it is taken in conjunction with the accompanying drawing wherein.

DETAILED DESCRIPTION OF THE PREFERRED EMBODIMENT

Figure 1:
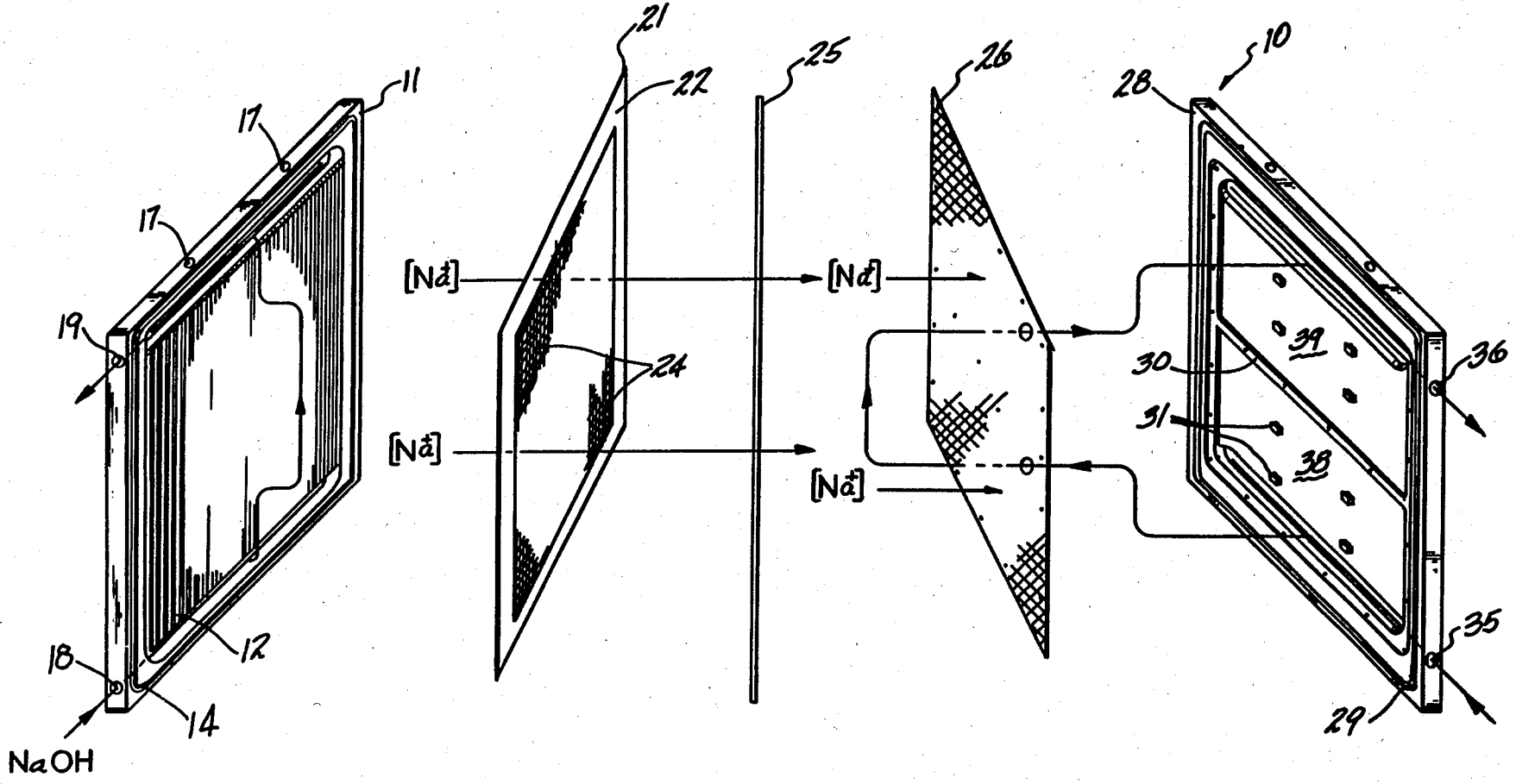
FIG. 1 is a diagrammatic exploded view of the electrolytic cell in which the coated separator of the present invention is used, showing the electrolyte flow paths and the ion flow paths.

As seen in the exploded and partially diagrammatic illustration in FIG. 1, a filter press membrane electrolytic cell, indicated generally by the numeral 10, is shown consisting of an anode backplate 11, separator means 21, cation selective membrane 25, a porous cathode plate 26, and a cathode backplate 28.

The anode backplate 11 and cathode backplate 28 form the opposing sides of the bipolar electrode, which can be machined from a stainless steel plate or can be cast stainless steel. The stainless steel plate can, for example, be formed of 304L or 316 stainless steel as thick as 1¼" which is resistant to corrosion and is simply fabricated by machining the flat plate to create chambers through which the anolyte and catholyte fluids can pass into their respective anolyte and catholyte chambers. The thickness of the stainless steel plate provides stiffness and an extremely precise flatness to the structure. The cathode plate 26 is mounted to the cathode backplate 28 by screws (not shown) which are screwed into cathode support pedestals 31, while the anode rods 12 may be welded, such as by TIG welding, in place without warping the stainless steel plate.

The anode structure includes a plurality of parallel positioned, vertically extending anode rods 12 welded at the top and bottom portions of the rods to the anode backplate 11. These rods 12 extend across the entire width of the anode backplate 11. These rods are, for example, ⅛" diameter nickel wire rods spaced apart from each other to create an anode inter-rod gap (not shown) of approximately 1/16" between adjacent rods. These anode rods 12 can be formed from nickel 200, or any other corrosion resistant composition providing low overvoltage characteristics. The vertical positioning of the anode rods 12 with the anode inter-rod gap provides clear flow channels from the bottom of the anode backplate 11, where the anolyte fluid enters via anolyte entry ports 18 into an anolyte distribution groove (not shown), to the top. Anolyte fluid flows vertically upwardly in the anode inter-rod gaps to the anolyte collection groove (not shown), before the liquid exits the cell through the anolyte exit ports 19. The vertical positioning of the anode rods 12 provides even current distribution across the anode and avoids gas blinding that can occur from the buildup of gas bubbles, which can consequently reduce the current density in the operating cell.

Both the anolyte entry ports 18 and the anolyte exit ports 19 have transition slots (both not shown) that are machined into the stainless steel plate. The anolyte entry port transition slots are machined into the anolyte distribution groove to provide a smooth transition surface that is tapered and avoids erosion corrosion which can interfere with the smooth flow of the anolyte into the cell 10. This erosion corrosion also will cause metal contamination as the erosion and corrosion occurs. The anolyte exit port transition slots are both similarly positioned and machined.

An anode gasket groove 14 is machined into the anode backplate 11 about the entire periphery. The groove, for example, is ⅜" wide by 3/16" deep to receive a rectangular anode gasket (not shown) that is ⅜" wide by ⅜" deep. This gasket can have a strip of material, such as material sold under the tradename of GORE-TEX or TEFLON, positioned over the gasket to come into contact with the plastic separator means 21 when the cell is compressed and assembled.

The plastic separator means 21 is formed from any material resistant to anolyte corrosion, such as polymers and preferably polypropylene has been employed. An 8 mesh polypropylene fabric with an approximately 40% open area has been successfully employed, as has a titanium dioxide filled polyethylene mesh. The separator means 21 has a separator frame 22, which is solid about the periphery and a separator mesh 24 on the interior of the separator frame 22. The mesh 24 is treated with a hydrophilic cOating to prevent gas bubbles from adhering to the mesh and the adjacent membrane by capillary action. A coating of titanium dioxide applied to the mesh 24 has been successfully employed as the hydrophilic coating. Preventing the buildup of gas bubbles on the membrane and in the mesh avoids cell voltage fluctuations during operation.

The use of the separator means 21 also has successfully prevented the buildup of regions of locally high acidity in the adjacent membrane where the membrane touches against the nickel anode rods 12. Having the membrane 25 touch against the nickel anode rods 12 can create pockets of high acidity because the sulfur species become oxidized to sulfuric acid due to the slow migration of the sulfur species back through the membrane during operation of the cell. The nickel oxide coating on the anode rods 12 breaks down and nickel corrosion occurs. This corrosion is transported through the membrane to the cathode side of the cell 10. There this nickel corrosion is reduced to the metallic state by the hydrosulfite solution. This metallic state nickel adheres tightly to the membrane on the cathode side and will impair the transport of ions and fluid through the membrane.

The key in this successful employment of the plastic separator means 21 is the process by which the hydrophilic coating is applied to the polymer surfaces of the separator means 21. The polypropylene mesh 24 is first prepared for the coating by washing in a detergent solution that removes surface contamination, such as dust or fingerprints or other contaminants. A solution containing sodium hypochlorite, sodium tripolyphosphate, and a surfactant has been successfully employed. The surface of the mesh 24 may be roughened by buffing with a wire brush to promote adhesion.

A light coating of an intermediate aqueous acidic titanium solution is applied to the polypropylene mesh, such as by immersing or spraying, and dried using a hot air blower until the coating turns from blue to a light yellow color. The intermediate acidic titanium solution is prepared by mixing together water, a surfactant, and titanium halide stabilized in an acid halide, to which is slowly added an alkali metal hydroxide to control the pH in the range from about 3.0 to about 4.0. This pH range is essential as it appears to maintain the pH range necessary to permit the titanium dioxide, formed during the subsequent oxidizing step, to precipitate directly as the coating on the polymeric substrate.

The titanium halide is formed by using shavings or granules of titanium from titanium metal by mixing the shavings or granules in about a 30% by weight acid selected from the group consisting of hydrochloric, hydrobromic or hydrofluoric acid, although hydrochloric is the preferred. The resulting mixture has titanium in the +3 valence state. A preferred alkali metal hydroxide used to achieve the desired pH range is sodium hydroxide.

A preferred preparation of the titanium chloride solution has followed the steps of adding together about 100 parts by weight of water, about 0.05 to about 0.5, and preferably about 0.1, parts by weight surfactant, about 1 to about 5 parts by weight of titanium chloride and about 0.1 to about 1.0 parts by weight hydrochloric acid, and preferably about 10 parts of about 25% by weight titanium chloride in about 5% by weight hydrochloric acid. About 5 to about 20 parts of an alkali metal hydroxide, and preferably about 10 parts of about 5% by weight sodium hydroxide, are slowly added with rapid stirring until the pH of the resulting solution is between the desired range of about 3.0 and about 4.0 . This solution is permitted to stand with stirring for about 1 hour prior to being contacted to the separator mesh 24 to improve the coating properties of the solution. The solution changes from a reddish purple to a blue purple during this standing time. If the solution is allowed to stand for too long, it apparently is altered, changing from the blue purple to a white color and losing the desired coating properties.

After the titanium solution coating is dried, the coated mesh is contacted with an oxidizing agent to convert the titanium salts to titanium dioxide. This conversion can be accomplished by drenching with or immersing in a solution of sodium or calcium hypochlorite of about 3% concentration. Any other suitable oxidizing agent may be used, such as, for example, hydrogen peroxide or a solution of chlorine dioxide. Excess oxidizing agent and surfactant may be washed off the mesh and the mesh is then dried.

The coating process appears to be successful in providing a more wettable surface without reducing the surface tension of liquids coming into contact with the separator mesh 24, apparently due to a reaction between the unstable titanium oxychlorides and oxygen. Some reactions are theorized to be possible between the titanium and the plastic polymer. It is also theorized that some of the oxygen necessary for the reaction is present by being adsorbed on the surface and inside of the polymer comprising the separator mesh 24. The reaction of the titanium solution on the surface of the polymer of the separator mesh 24 causes a strong surface bond to form and a well adhering film is obtained.

While all of the variables of the reaction in the coating process are not completely understood, it appears as though neutralization of the titanium chloride appears to be an essential first step. Also essential is the apparent use of a surfactant to help stabilize the titanium solution so that it will have a useful life of from about 1 to 3 days before it decomposes to form a titanium dioxide suspension. Any appropriate surfactant may be used in the titanium solution. One that has specifically worked well is a non-ionic surfactant sold under the tradename Triton X-100. It is also possible that the coating process can be improved by diffusing the oxygen or chlorine into the polymer that forms the mesh 24 of the separator means 21.

The coating process thus described herein creates the titanium dioxide by converting the dried titanium solution coating in situ on the mesh 24 of the separator means 21 and produces a resulting surface that is measurably more wettable than non-coated surfaces. Utilizing Young's concept of a contact angle $\theta$ between the drop of liquid and a solid plane surface as a measure of wettability of the surface, coated surfaces of the central mesh portion 24 were observed through a 50 power microscope to have a contact angle of less than about 5 degrees and apparently about 1 or 0 degrees. The contact angle is a useful inverse measure of spreadability or wettability of a liquid on a surface since as the contact angle decreases, the tendency for the liquid to spread increases.

Microscopic examination also showed that the translucent coating of titanium dioxide preferably covers about 80%, but at least about 50%, of the surface of the separator mesh 24. Tests conducted on the separator mesh 24 where the titanium coating had not been applied to the mesh verified that the surfactants used to wash the mesh did not remain on the mesh and were not effective by themselves to reduce the contact angle.

The anode of the cell 10 using the coated separator means 21 has been designed so that the anolyte which is electrolyzed in the cell 10 is any suitable electrolyte which is capable of supplying alkali metal ions and water molecules to the cathode compartment. Suitable as anolytes are, for example, alkali metal halides, alkali metal hydroxides, or alkali metal persulfates. The selection of anolyte is in part dependent on the product desired. Where a halogen gas such as chlorine or bromine is wanted, an aqueous solution of an alkali metal chloride or bromide is used as the anolyte. Alkali metal hydroxide solutions are chosen where oxygen gas or hydrogen peroxide is to be produced. If persulfuric acid is the desired product, an alkali metal persulfate is employed. However, alternate materials of construction, such as titanium group metals for the anolyte wetted parts with an alkali metal chloride anolyte, would be necessary for each particular anolyte utilized.

In any case, concentrated solutions of the electrolyte selected are employed as the anolyte. For example, where sodium chloride is selected as the alkali metal chloride, suitable solutions as anolytes contain from about 12 to about 25 percent by weight of NaCl. Solutions of alkali metal hydroxides, such as sodium hydroxide, contain from about 5 to about 40 percent by weight of NaOH.

The cell 10 preferably has been operated with caustic soda. Where caustic soda (NaOH) is used, water and the caustic soda enter through the anolyte entry ports 18 and the solution flows along the high velocity flow path between the adjacent anode rods 12 and the anode inter-rod gaps at the rear of the anolyte compartment toward the top of the cell 10. Thus, most of the anolyte fluid volume flow occurs between the anode rods 12 and within the hydrophilically treated separator mesh 24. The sodium ions migrate across the membrane, being produced as a result of the electrolysis reaction forming oxygen, water and sodium ions, $$4NaOH \rightarrow O_2 + 4Na^+ + 2H_2O.$$

Depleted caustic passes out with oxygen and water through the anolyte exit or collection ports 19.

The cathode backplate 28 is also machined from a solid stainless steel plate. Since the cell is bipolar, the cathode is on one side of the stainless steel plate on the cathode backplate 28 side, while the anode backplate 11 and the anode is on the opposing side. The cathode backplate 28 has catholyte entry ports 35 on the opposing sides of the bottom portion of cathode backplate 28 that feed in catholyte into a catholyte distribution groove (not shown). The catholyte distribution groove, catholyte entry ports 35, and the machined catholyte transition slots (not shown) are positioned just above the corresponding anolyte distribution groove, anolyte ports 18 and the anolyte transition slots, but are on the opposite side of the solid stainless steel electrode plate.

A lower catholyte chamber 38 is positioned immediately above the catholyte distribution groove 32. The lower catholyte chamber 38 is separated from the upper catholyte chamber 39 by a generally horizontally positioned cathode flow barrier 30. Flow barrier 30 extends across the entire width of the catholyte chamber and protrudes outwardly from the plane of the catholyte backplate 28. Cathode flow barrier 30 interrupts the vertical flow of catholyte fluid upwardly from the lower catholyte chamber 38 into the upper catholyte chamber 39, thereby causing the catholyte fluid to flow in a path shown by the arrows in FIG. 1 that takes it twice through the cathode plate 26 enroute to the upper catholyte chamber 39. This flow path results in a cathode with a highly effective surface area, but requires the use of a very porous cathode plate that will permit at least 30% by volume of the catholyte fluid to flow through the porous cathode plate 26 rapidly to hold to a minimum the residence time of the catholyte in the cell. Once the catholyte fluid has reached the upper catholyte chamber 39 it enters the catholyte collection groove (not shown) and exits the cell through the machined catholyte exit transition slots (not shown) and catholyte exit ports 36.

Weep holes (not shown) can be used in the cathode flow barrier 30 to permit hydrogen gas to rise from the lower catholyte chamber 38 to the upper catholyte chamber 39. Alternately or concurrently additional weep holes can be used to permit the hydrogen gas to pass out of the interelectrode gap between the walls of the lower and upper catholyte chambers 38 and 39 and the cathode plate 26 just below the cathode flow barrier 30 and then back through the cathode plate 26 opposite the catholyte collection groove.

The cathode plate 26 is held in place on the catholyte backplate 28 by a plurality of screws (not shown) that seat within the plurality of cathode support pedestals 31 within the lower and upper catholyte chambers 38 and 39.

The cathode plate 26 is a highly porous multilayer structure. It comprises a support layer formed of perforated stainless steel. This support layer forms the mounting base and protects the innermetal fiber felt layer that is formed of, for example, 15% dense, very fine 4 to 8 micron fibers and 15% dense 25 micron fibers laid on top of one another. A wire screen of, for example, 18 mesh with a 0.009 inch wire diameter is then placed atop the fiber felt to form a cathode that has a porosity of preferably between 80 and 85%. The cathode plate 26, thus, is a four layered sintered composite with all of the materials made of stainless steel, preferably 304 or 316 stainless steel, and in the appropriate sheet size. The highly effective surface area of cathode plate 26 is achieved by the use of low density metal felt formed from very fine elements.

A cathode gasket groove 29 extends about the top, bottom and side peripheral portions 23 of the cathode backplate 28. Although not shown, a ⅜" round EPDM, ethylene-propylene-diene monomer, gasket is used to seat within the cathode gasket groove 29 to effect fluid-tight sealing.

Reduction occurs at the cathode in the cell 10 by the electrolysis of a buffered aqueous solution of an alkali metal bisulfite. A typical reaction is as follows:

$$4NaHSO_3+2e^-+\rightarrow Na_2S_2O_4+2Na_2SO_3+2H_2O.$$

Depleted caustic and sulfur dioxide are mixed to form $NaHSO_3$ that is fed into the catholyte distribution groove via the catholyte entrance ports 35 and the catholyte transition slots. This catholyte liquid then rises vertically upwardly until it passes out through the cathode plate 26. The cathode flow barrier 30 acts as a block to the straight vertical flow of the catholyte fluid upwardly from the lower catholyte chamber 38 into the upper catholyte chamber 39. There is an approximately ⅛" interelectrode cathode gap between the walls of the lower and upper catholyte chambers 38 and 39 and the cathode plate 26 that is seated on the cathode support pedestals 31. The catholyte fluid then passes through the cathode plate 26 and continues flowing upwardly through the cathode-membrane gap until it passes the cathode flow barrier 30. At hhis point the catholyte fluid passes back through the highly porous cathode plate 26 into the upper catholyte chamber 39 and then into the catholyte collection groove. The cell product solution containing $Na_2S_2O_4$ (dithionite) exits the cell 10 through the catholyte exit transition slots and the catholyte exit ports 36.

A buffer solution containing from about 40 to about 80 gpl of bisulfite is utilized with the catholyte because of sodium thiosulfate formation resulting from the reduction and decomposition of hydrosulfite (dithionite) and the pH change of the catholyte as bisufite is consumed and sulfite is formed according to the reaction $$Na_2S_2O_4 +2e^-+2NaHSO_3\rightarrow Na_2S_2O_3+2Na_2SO_3+H_2O.$$

This hydrosulfite decomposition reaction is electrolytically driven by the presence of electrons. When the potential is increased, so is the current density and to a point, the reaction rate of this undesired thiosulfate producing reaction.

The value of the multiple layered cathode plate 26 is particularly evident in its selectivity. Because the multiple layered electrode has an increased surface area, it requires less voltage or a lower potential to drive the primary reduction reaction that produces the desired hydrosulfited product and, thereby, reduces the amount of the undesired thiosulfate produced by the hydrosulfite decomposition reaction. The increased surface area permits the potential to be maintained at the lower level where the primary or desired hydrosulfite producing reaction predominates and generally below the level where the hydrosulfite decomposition reaction becomes a factor.

The hydraulic pressure in cell 10 is established so that the membrane 25 is kept pressed against the separator means 21 and off of the cathode plate 26. Keeping the membrane 25 so positioned also permits the flow path through the cathode plate to be accomplished. The cathode flow barrier 30 further contributes to the hydraulics of the cell 10 by achieving a uniform pressure across the entire height of the cathode due to the flow inversion characteristics achieved by the multiple flow paths through the cathode plate 26.

An additional benefit is obtained from the solid separator frame 22 since it forms a good seal with the adjacent membranes 25 to prevent leakage. A strip of, for example, polypropylene foam or material sold under the tradename GORE-TEX about the frame 22 cooperates with the previously mentioned EPDM gasket and with the separator frame 22 to form and effective seal.

The electrolytic cell 10 is operated at current densities which are sufficient to produce solutions of alkali metal hydrosulfites having the concentrations desired. For example, where sodium hydrosulfite is produced for commercial sale, the solutions contain from about 120 to about 160 grams per liter. However, since the alkali metal hydrosulfite solutions sold commercially are usually diluted before use, these dilute aqueous solutions can also be produced directly by the process.

Current densities of at least 0.5 kiloamperes per square meter are employed. Preferably the current density is in the range of from about 1.0 to about 4.5, and more preferably at from about 2.0 to about 3.0 kiloamperes per square meter. At these high current densities, the electrolytic cell 10 operates to produce the required volume of high purity alkali metal hydrosulfite solution which can be employed commercially without further concentration or purification.

The electrolytic membrane cell 10 employs a cation exchange membrane between the anode and the cathode compartments which prevents any substantial migration of sulfur-containing ions from the cathode compartment to the anode compartment. A wide variety of cation exchange membranes can be employed containing a variety of polymer resins and functional groups, provided the membranes possess the requisite sulfur ion selectivity to prevent the deposition of sulfur inside of the membranes. Such deposition can blind the membranes, the result of sulfur species diffusing through the membranes and then being oxidized to create acid within the membranes that causes hydrosulfite and thiosulfate to decompose to sulfur in acidic conditions. This selectivity can be verified by analyzing the anolyte for sulfate ions.

Suitable cation exchange membranes are those which are inert, flexible, and substantially impervious to the hydrodynamic flow of the electrolyte and the passage of gas products produced in the cell. Cation exchange membranes are well-known to contain fixed anionic groups that permit intrusion and exchange of cations, and exclude anions, from an external source. Generally the resinous membrane has a matrix or a cross-linked polymer to which are attached charged radicals, such as $—SO_3^=$, $—COO^-$, $—PO_3^=$, $—HPO_2^-$, $—AsO_3^=$, and $—SeO_3^-$ and mixtures thereof. The resins which can be used to produce the membranes include, for example, fluorocarbons, vinyl compounds, polyolefins, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid groups" are meant to include salts of sulfonic acid or salts of carboxylic acid groups by processes such as hydrolysis. Suitable cation exchange membranes are sold commercially by E. I. DuPont de Nemours & Co., Inc. under the trademark "Nafion", by the Asahi Glass Company under the trademark "Flemion", by the Asahi Chemical Company under the trademark "Aciplex". Perfluorinated sulfonic acid membranes are also available from the Dow Chemical Company.

The membrane 25 is positioned between the anode and the cathode and is separated from the cathode by a cathode-membrane gap which is wide enough to permit the catholyte to flow between the cathode plate 26 and the membrane 25 from the lower catholyte chamber 38 to the upper catholyte chamber 39 and to prevent gas blinding, but not wide enough to substantially increase electrical resistance. Depending on the form of cathode plate 26 used, this cathode-membrane gap is a distance of from about 0.05 to about 10 , and preferably from about 1 to about 4 millimeters. The cathode-membrane gap can be maintained by hydraulic pressure or mechanical means. This design and the catholyte flow path permits almost all of the catholyte liquid to contact the active area of the cathode. Further, with this design the majority of the electrolytic reaction occurs in the cathode area nearest the anode.

Suitable porous cathode plates 26 used in the cell 10 have at least one layer with a total surface area to volume ratio of greater than 100 $cm^2$ per $cm^3$, preferably 250 $cm^2$ per $cm^3$, and more preferably greater than 500 $cm^2$ per $cm^3$. These structures have a porosity of at least 60 percent and preferably from about 70 percent to about 90 percent, where porosity is the percentage of void volume. The ratio of total surface area to the projected surface area of the porous cathode plate 26, where the projected surface area is the area of the face of the cathode plate 26, is at least about 30:1 and preferably at least from about 50:1 ; for example, from about 80:1 to about 100:1.

Current is conducted into the cell 10 through anode and cathode current conductor plates (not shown). Plates of copper the size of the electrodes are placed against the end cathode and end anode in each cell 10. Electrical connections are made directly to these copper plates. An insulator plate made, for example, of polyvinyl chloride or other suitable plastic, and a compression plate (both not shown) made for example, of stainless steel or steel, are placed against each end of the cell 10 before it is assembled to form a sandwich around the desired number of electrodes that are positioned therebetween.

The cell of the instant invention could also be designed as monopolar, requiring that both sides of each stainless steel plate be identically machined and that half electrodes be used as the end electrodes in the assembled cell. The current conductors in the monopolar design would then be standard copper electrical terminals for each electrode.

Additionally the cell of the present invention could be utilized in electrochemical reactions other than the production of hydrosulfite. Typical is the production of organic products by electrochemistry, such as the electrochemical transformations of pyridines through oxidation or reduction reactions in a cation-exchange membrane divided cell of the instant design.

Employing the novel design of the cell 10, concentrated alkali metal hydrosulfite solutions are produced having low concentrations of alkali metal thiosulfates as an impurity in electrolytic membrane cells operating at high current densities, substantially reduced cell voltages, and high current efficiencies.

In order to exemplify the results achieved, the following examples are provided without an intent to limit the scope of the instant invention to the discussion therein.

EXAMPLE 1

A cell of the type shown in FIG. 1 was assembled from three stainless steel plates which were mounted on a rack to form two anode/cathode pairs whose active electrode area was about 0.172 square meters each. The plates formed two half electrodes, one a cathode and the other an anode, sandwiched about a bipolar electrode with opposing anode and cathode faces. The outside dimensions of the electrode plates were about 17 inches wide by about 18.5 inches high and about 1.0 inches thick.

The anodes were comprised of about forty-seven (47) ⅛ inch diameter nickel 200 rods welded onto the anode backplate, as shown generally in FIG. 1, with approximately 1/16 inch separation between the rods. The anolyte collection and distribution grooves were about 1.25 inches wide and about 0.61 inches deep.

The cathode plate was formed from a four layered sheet cut to size. The first layer was a support layer formed of perforated stainless steel 0.036 inches thick with 1/16 inch holes on ⅛ inch 60 ° staggered centers having a 23% open area. The second layer was a 0.62 pounds per square foot layer of 304 stainless steel fibers about 25 microns in diameter. The third layer was a 0.12 pounds per square foot layer of 304 stainless steel fibers about 8 microns in diameter. The fourth layer was an 18″×18″ mesh of about 0.009 inch diameter wire cloth. These layers were compressed together and bonded by sintering in a hydrogen atmosphere to form a single sheet with a thickness of about 0.1.55 inches. The cathode sheet was cut to form a cathode plate of about 18.5 inches by about 17 inches.

The cathode plate was mounted onto the stainless steel cathode backplate using 20 screws of about ⅛ inch diameter that seated into the cathode support pedestals within the catholyte chambers. A small coating of appropriate electrical joint compound was used on the threads of the screws and a silicon cement was placed over the head of each screw to prevent the screw from becoming an active part of the cathode assembly.

Six (06) 1/6 inch diameter holes were drilled in the cathode plate to permit gas bubbles trapped within the cell to escape. Three of the holes were drilled near the top of the cell opposite the catholyte collection groove and three just below the cathode flow barrier.

Separator means were formed from polypropylene mesh treated with a coating of titanium dioxide in the specific manner previously described. The separators were mounted in 1/16 inch thick separator frames cut to fit just inside the gasket groove in the cell. The mesh was first washed in a detergent solution containing sodium hypochlorite, sodium tripolyphosphate and the surfactant Triton X-100. The surface of the mesh was roughened by buffing with a wire brush. A light coating of the specific titanium solution previously described was sprayed on the mesh and then air dried with a hot air blower. The light yellow colored coating was then drenched with a solution of about 3% sodium hypochlorite to convert the titanium salts to titanium dioxide. Excess hypochlorite and surfactant were washed off the mesh and the separator mesh was dried.

Gasket grooves about 0.375 inches wide and about 0.187 inches deep were machined into both the anode and cathode backplates. On the anode side of the cell about a 0.375 inch square gasket was used with about a 0.5 inch wide strip of about 0.060 thick GORE-TEX® gasket tape placed on top. In the cathode gasket groove a rubber O-ring of about a 0.378 inch diameter was used. The cell was assembled using a portable hydraulic assembly system described in U.S. Pat. No. 4,430,179 that compressed the cell together so that approximately a ⅛ inch gap between the anode and the cathode plates remained. The cell was then secured by retaining nuts.

The cell was operated continuously for 42 days. The cell employed a NAFION® NX 906 perfluorinated membrane that was soaked in about 2% sodium hydroxide solution for at least 4 hours prior to assembling.

The cell was operated at a temperature of approximately 25° C. with a total catholyte flow rate of about 6 gpm and a total anolyte flow rate of about 4 gpm. Excess anolyte containing about 19% sodium hydroxide was continuously purged and added to the catholyte circulation while the anolyte was continuously replenished with the addition of about 69 grams per minute of about 35% sodium hydroxide solution. About 230 milliliters per minute of deionized water was continuously added to the catholyte, as was sulfur dioxide to the catholyte to maintain a pH of between about 5.4 and about 5.8 and a sulfite to bisulfite molar ratio of about 1:3 to about 1:8.

Product catholyte was drawn from the cell continuously at a rate of about 287 milliliters per minute and was analyzed periodically during each day. The product catholyte reflected in the following Table I was analyzed from samples taken at the same time each day. These data are representative of the operation of the cell during 4 days of operation under optimized conditions. The catholyte was analyzed for sodium hydrosulfite, sodium thiosulfate, sodium sulfite and sodium bisulfite content.

TABLE I

| Day | $Na_2S_2O_4$ (gpl) | $Na_2S_2O_3$ (gpl) | $Na_2SO_3$ (gpl) | $NaHSO_3$ (gpl) | Average Current Density ($KA/m^2$) | Current Efficiency (%) | Average Voltage Per Bipolar Electrode (volts) |
|---|---|---|---|---|---|---|---|
| 5 | 128.60 | 1.01 | 11.55 | 46.60 | 2.03 | 97.5 | 2.76 |
| 6 | 126.80 | 1.01 | 12.10 | 50.70 | 2.06 | 96.0 | 2.75 |
| 7 | 126.00 | 1.51 | 8.80 | 46.70 | 2.03 | 97.0 | 2.73 |
| 8 | 127.20 | 0.94 | 8.30 | 47.40 | 2.05 | 97.0 | 2.95 |

While the preferred structure in which the principles of the present invention have been incorporated as shown and described above, it is to be understood that the invention is not to be limited to the particular details thus presented, but, in fact, widely different means may be employed in the practice of the broader aspects of this invention. For example, while the anode backplate is shown and described as employing round wire rods on its surface, flat rectangular bars or other appropriate geometrically shaped structures, such as triangular, pentagonal, hexagonal, octagonal, etc. could be equally well utilized. The separator mesh could also be assembled in the cell between the membrane and the cathode plate, in conjunction with the hydraulic pressure being changed so that the membrane is forced off of the anode rods and against the separator mesh. The process of this invention could also equally well be used to prepare hydrophilic titanium dioxide coatings on polymer fabrics such as nylon, polyethylene or polyester to produce hydrophilic surfaces. Such hydrophilic properties can be useful in clothing or filter applications, for example. The scope of the appended claims is intended to encompass all obvious changes in the details, materials, and arrangement of parts, which will occur to one of skill in the art upon a reading of the disclosure.

Having thus described the invention, what is claimed is:

1. A process for applying a solution to a polymeric mesh material and converting the solution to a hydrophilic coating while on the polymeric mesh material to increase the wettability of the surface of the polymeric mesh material, the mesh material having a predetermined open area in its surface and being used as a separator in an electrolytic membrane cell between an electrode and a membrane, the process comprising the steps of, (a) removing surface contaminants from the polymeric mesh material;

(b) contacting the polymeric mesh material with an aqueous acidic titanium halide solution made by mixing together water, a surfactant, titanium halide and an acid selected from the group consisting of hydrochloric, hydrobromic and hydrofluoric to form an intermediate acidic titanium solution and then adding an alkali metal hydroxide to the intermediate titanium solution until the pH is in the range from about 3.0 to about 4.0;

(c) drying the titanium chloride solution onto the surface of the polymeric mesh material to form a coating thereon; and (d) converting the coating to a titanium dioxide coating by contacting the coating with an oxidizing agent selected from the group consisting of sodium hypochlorite, calcium hypochlorite, hydrogen peroxide and chlorine dioxide.

2. The process according to claim 1 wherein the aqueous acidic titanium chloride solution contacting the polymeric mesh material is prepared by (i) mixing together about 100 parts by weight of water with about 0.05 to about 0.5 parts by weight of a surfactant, about 1 to about 5 parts by weight of titanium chloride and about 0.1 to about 1.0 parts by weight of an acid selected from the group consisting of hydrochloric, hydrobromic and hydrofluoric to form an intermediate acidic titanium solution, and then (ii) adding about 5 to about 20 parts by weight of an alkali metal hydroxide to the intermediate acidic titanium solution until the pH is in the range of from about 3.0 to about 4.0.

3. The process according to claim 1 wherein the aqueous acidic titanium chloride solution contacting the polymeric mesh material is prepared by (i) mixing together about 100 parts by weight of water, about 0.1 parts by weight of a surfactant, and about 10 parts of about 25 percent by weight titanium chloride in about 5 percent by weight hydrochloric acid to form an intermediate acidic titanium solution and then (ii) slowly adding about 10 parts of about 5 percent by weight sodium hydroxide to the intermediate acidic solution until the pH is in the range of between about 3.0 and about 4.0.

4. The process according to claim 1 wherein the intermediate acidic titanium solution is allowed to stand with stirring for about an hour prior to use.

5. The process according to claim 4 wherein the coating of intermediate acidic titanium solution is dried until it turns from blue to a light yellow color.

6. The process according to claim 5 further comprising drying the coating of intermediate acid titanium solution by using hot air.

7. The process according to claim 6 further comprising removing surface contaminants from the surface of the polymeric mesh material by washing in a detergent solution containing sodium hypochlorite, sodium tripolyphosphate and a surfactant.

8. The process according to claim 7 wherein the surface of the polymeric mesh material is further prepared by roughening.

9. The process according to claim 7 further comprising washing excess detergent solution from the polymeric surface of the polymeric mesh material.

10. The process according to claim 9 further comprising drying the surface of the polymeric mesh material after washing excess detergent solution.

11. The process according to claim 10 wherein the polymeric mesh material is formed from polypropylene.

12. The process according to claim 1 wherein the polymeric mesh material is formed from the group consisting of nylon, polyethylene and polyester.

13. The process according to claim 1 wherein the surfactant in the intermediate acidic titanium solution is non-ionic.

14. The process according to claim 13 wherein the titanium dioxide coating covers at least about 50 percent and preferably about 80 percent of the surface of the polymeric mesh material.

15. The process according to claim 14 wherein the contact angle of the polymeric mesh material with the coating thereon is about 5 degrees.

16. A process of applying a hydrophilic coating to the surface of a substrate comprising the steps of:

(a) removing contaminants from the surface of the substrate;

(b) contacting the surface with an aqueous acidic titanium chloride solution made by mixing together water, a surfactant, titanium chloride, and an acid selected from the group consisting of hydrochloric, hydrobromic and hydrofluoric to form an intermediate acidic titanium solution and then adding an alkali metal hydroxide to the intermediate acidic titanium solution until the pH is in the range from about 3.0 to about 4.0;

(c) drying the titanium chloride solution onto the surface of the substrate to form a coating thereon; and (d) converting the coating in situ on the substrate to a titanium dioxide coating by contacting the coating with an oxidizing agent selected from the group consisting of sodium hypochlorite, calcium hypochlorite, hydrogen peroxide and chlorine dioxide.

17. The process according to claim 16 wherein the aqueous acidic titanium chlorine solution contacting the surface is prepared by (i) mixing together about 100 parts by weight of water with about 0.05 to about 0.5 parts by weight of a surfactant, about 1 to about 5 parts by weight of titanium chloride and about 0.1 to about 1.0 parts by weight of an acid selected from the group consisting of hydrochloric, hydrobromic and hydrofluoric to form an intermediate acidic titanium solution, and then (ii) adding about 5 to about 20 parts by weight of an alkali metal hydroxide to the intermediate acidic titanium solution until the pH is in the range of from about 3.0 to about 4.0.

* * * * *